US005240229A

United States Patent [19]

Timmons

[11] Patent Number: 5,240,229

[45] Date of Patent: Aug. 31, 1993

[54] BAILER HOIST

[76] Inventor: Robert D. Timmons, S 9061, Meadowdale Road, Prairie du Sac, Wis. 53578

[21] Appl. No.: 792,656

[22] Filed: Nov. 15, 1991

[51] Int. Cl.[5] ..... B66D 1/28

[52] U.S. Cl. ..... 254/338; 254/335

[58] Field of Search ..... 254/334, 335, 336, 338

[56] References Cited

U.S. PATENT DOCUMENTS

| | | | |
|---|---|---|---|
| 2,779,569 | 1/1957 | Gills | 254/334 |
| 3,165,297 | 1/1965 | Thompson, III et al. | 254/344 |
| 3,568,797 | 3/1971 | Hardy | 254/336 |
| 3,964,182 | 6/1976 | Pomeret et al. | 254/334 |
| 3,991,978 | 11/1976 | Jones | 254/335 |
| 4,086,035 | 4/1978 | Klaeger, Jr. et al. . | |
| 4,368,909 | 1/1983 | Alexander, Jr. . | |
| 4,597,562 | 7/1986 | Joyce | 254/334 |
| 4,620,693 | 11/1986 | Vailars et al. | 254/335 |
| 4,695,040 | 9/1987 | Hantschk | 254/334 |
| 4,706,939 | 11/1987 | Gagne | 254/338 |
| 4,771,988 | 9/1988 | Scroggins | 254/336 |
| 4,795,136 | 1/1989 | Haefner | 254/336 |

*Primary Examiner*—Katherine Matecki

*Attorney, Agent, or Firm*—Shlesinger, Arkwright & Garvey

[57] ABSTRACT

A hoist for lifting and lowering an equipment in a well comprises base member; a belt for removably securing the base member to a vertical wall portion of the well casing; a boom with its first end being secured to the base member and its second end extending above the well casing; and a winch assembly operably associated with the boom for lowering and lifting the equipment in the well.

17 Claims, 3 Drawing Sheets

BAILER HOIST

FIELD OF THE INVENTION

The present invention generally relates to hoists for lifting or lowering an equipment in well, and particularly to hoists used in environmental water monitoring wells.

BACKGROUND OF THE INVENTION

Environmental monitoring wells are typically used in monitoring underground water quality, in cases where contamination is suspected. In order to obtain water samples from the well, a bailer or a pump is lowered into the well with a hoist. Typically, the hoist would be supported on a tripod positioned over the well casing. Where there is uneven ground around the well casing, one would recognize that it would be relatively difficult to position the tripod in a stable configuration while maintaining it centered above the well opening.

The present invention solves the above problem by providing a hoist that secures to the well casing and that includes means for automatic centering or aligning over the well opening.

OBJECTS AND SUMMARY OF THE INVENTION

It is an object of the present invention to provide a hoist that can be directly secured to the well casing, thereby avoiding the use of a tripod supported hoist that is relatively time consuming to install, specially where the ground surface is relatively uneven.

It is another object of the present invention to provide a hoist that can be secured to any type of well casing or wellhead, be it circular or square in cross-section.

It is still another object of the present invention to provide a hoist that can be relatively easily broken down for transporting to the field.

It is yet another object of the present invention to provide a hoist that is relatively light for one person to handle.

It is yet another object of the present invention to provide a hoist that is relatively inexpensive to manufacture.

It is another object of the present invention to provide a hoist that is self-centering or self-aligning once it is secured to the well casing, thereby avoiding the time consuming procedure of adjusting the legs of the prior art tripod support to center its apex over the well opening.

It is still another object of the present invention to provide a hoist that can handle various lengths of equipment.

It is yet another object of the present invention to provide a hoist that is lightweight, capable of being installed by one individual, easily knocked down for transport, and manually operable.

In summary, the present invention provides a hoist that can be secured directly to a well casing of any cross-sectional shape and disposed above the ground and is automatically self-centering once secured, thereby avoiding the need for time consuming adjustments required in prior art tripod-supported hoists.

These and other objects of the present invention will become apparent from the following detailed description.

BRIEF DESCRIPTIONS OF THE DRAWINGS

DETAILED DESCRIPTION OF THE INVENTION

Figure 1:
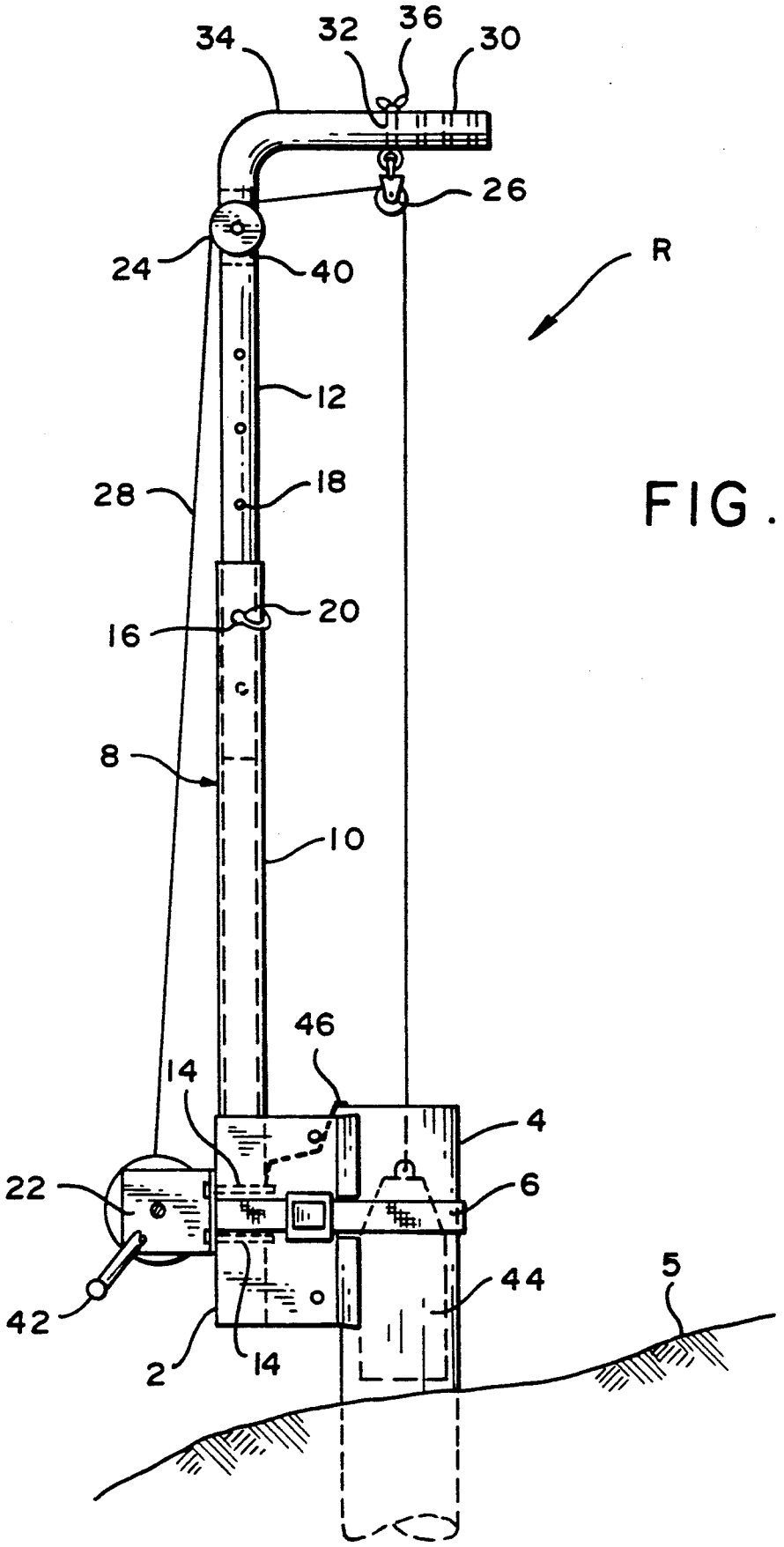
FIG. 1 is a side elevational view of a hoist made in accordance with the present invention, shown secured to a well casing.

An embodiment of a hoist R in accordance with the present invention is disclosed in FIG. 1. The hoist R includes a base member 2 secured to a well casing or wellhead 4 by means of a removable belt 6. The well casing 4 is shown extending above an uneven ground surface 5. The well casing or wellhead 4 can have a circular cross-section or square, as generally indicated at 7 and 9, respectively, in FIG. 3.

A boom 8 has a first longitudinal member 10 and a second longitudinal member 12 which is telescopically received within the first member 10. One end of the member 10 is secured to the base member 2 with a pair of bolts 14. The other end of the member 10 has a radial opening 16, which cooperates with one of a number of openings 18 disposed in one end of the member 12. A pin 20 secures the members 10 and 12 to each other through the openings 16 and 18, as best shown in FIG. 1. The longitudinal axis of the vertical portion of the boom 8 is preferably aligned with or parallel to the longitudinal axis of the base member 2.

Figure 2:
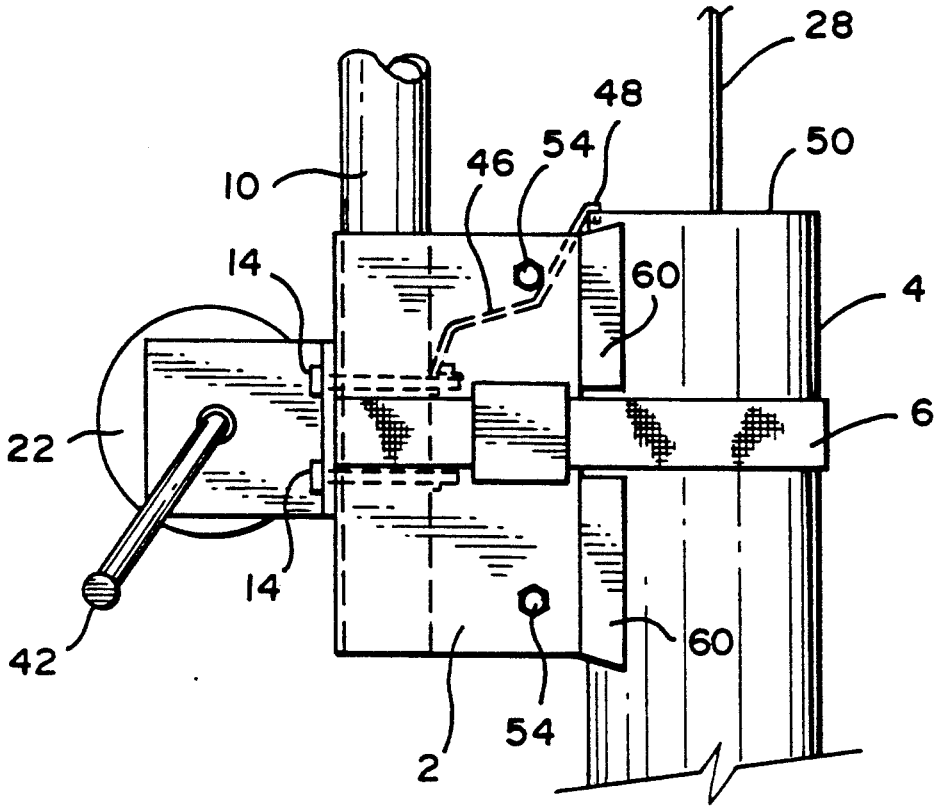
FIG. 2 is an enlarged, side elevational view of the base portion of the hoist shown in FIG. 1.
Figure 3:
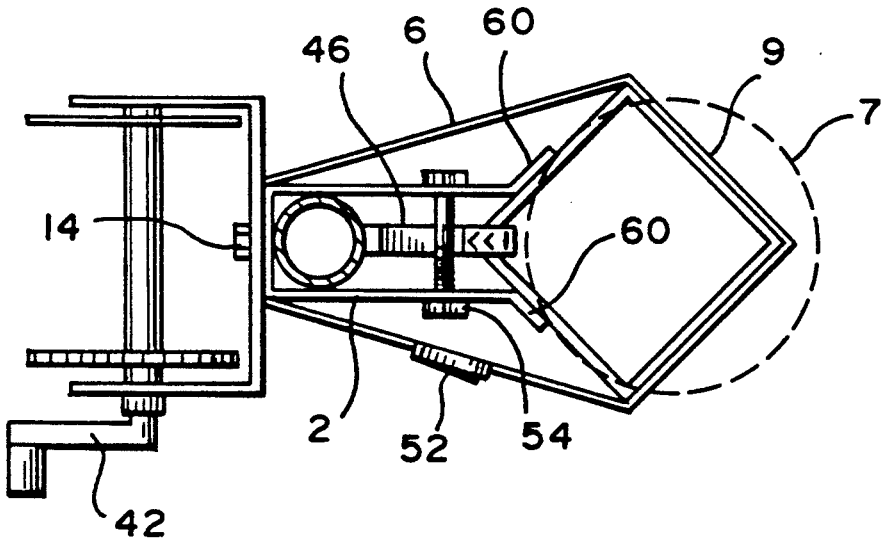
FIG. 3 is a top view, with portions shown in cross-section, of the base portion of the hoist shown in FIG. 2.

A winch 22 is secured to the base member 2 by means of the bolts 14, as best shown in FIGS. 1, 2 and 3.

Figure 5:
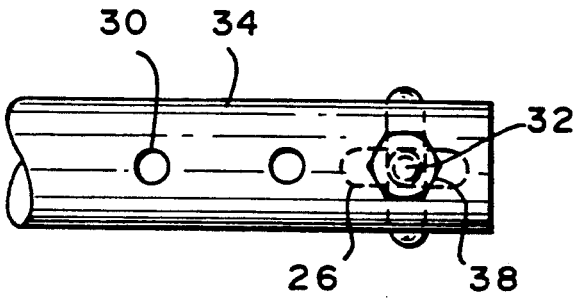
FIG. 5 is an enlarged, top view of the top portion of the hoist in FIG. 1.

Pulleys 24 and 26 guide a rope or cable 28 from the winch 22 over the opening of the well casing 4, as best shown in FIG. 1. The pulley 26 is positionable in a number of positions along a horizontal arm of the member 12 by means of radial holes 30, as best shown in FIGS. 1 and 5. The pulley 26 has a threaded rod 32 that is received in one of the holes 30 and is secured to the horizontal arm 34 by means of a wing nut 36 or a standard nut 38, as best shown in FIGS. 1 and 5. The pulley 24 is rotatably secured within a slot 40 at the upper vertical portion of the member 12, as best shown in FIG. 1.

The winch 22 is hand operated by means of a crank 42, as best shown in FIGS. 1, 2 and 3. The free end of the rope 28 is shown secured to an equipment 44, which may be a bailer, a submersible pump, etc.

A person of ordinary skill in the art will understand that there are other equivalent means for lowering or raising the bailer 44 in the well casing 4. Other means that provide a mechanical advantage can be used, such as a pulley system, etc.

A clip 46 secured to the base member 2 helps in initially securing the hoist to the well casing 4 while the belt 6 is tightened around the base member 2 and the well casing 4. The clip 46 has a hook portion 48 that secures to the top edge 50 of the well casing 4, as best shown in FIG. 2. The clip 46 is secured to the base member 2 by means of the bolts 14, as best shown in FIG. 4.

The belt 6 has a ratchet buckle 52 to aid in tensioning the belt 6 around the casing 4. The belt 6 is secured between the winch 22 and the base member 2, as best shown in FIG. 3. A pair of bolts 54 prevents the base member 2 from spreading when the belt 6 is tightened. The belt 6 is preferably made of nylon or other suitable materials. A person of ordinary skill in the art will understand that the belt 6 can also be made from metal bands with suitable closure means.

Figure 4:
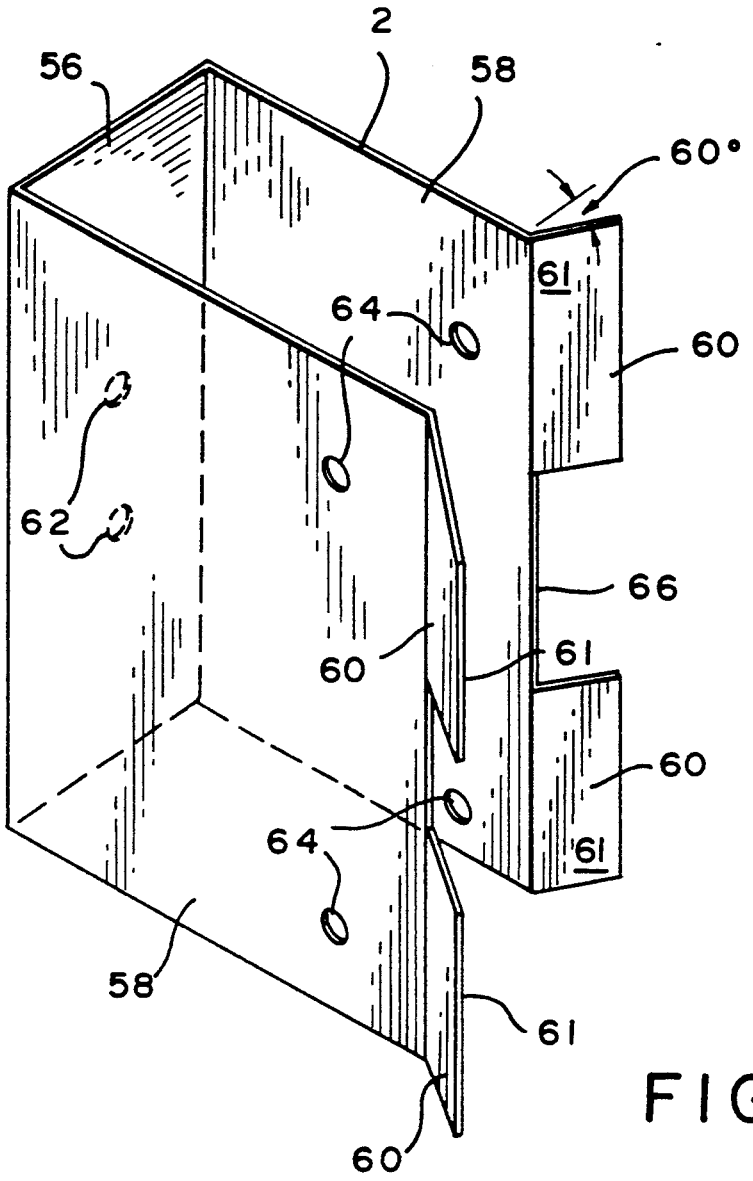
FIG. 4 is a perspective view of a base member of the hoist in FIG. 1.

The base member 2 is preferably made from a sheet material and bent into a substantially "U"-shaped configuration with a longitudinal axis, as best shown in FIG. 4,. The base member 2 has a base wall 56 and a pair of parallel side walls 58 extending from the base wall 56. Each of the side walls 58 has end portion flaps 60 extending outwardly and disposed approximately 60° relative to the respective side wall transverse line, as best shown in FIG. 4. Each of the flaps 60 has surface 61. Each of the flaps 60 intersects with its respective opposite flap in an imaginary line that is substantially parallel to the axis of the base member 2 such that engagement of the flap surfaces 61 against the well casing 4 would automatically align the base member axis with the axis of the well casing 4.

Openings 62 cooperate with the bolts 14 for securing the base member 2 to the first member 10 and to the winch 22. Openings 64 cooperate with the bolts 54 to prevent the side walls 58 from spreading when the base member 2 is pressed against the well casing 4.

The base member 2 is preferably made from a spring-type resilient material to provide the flap surfaces 61 with increased grabbing force against the well casing 4.

OPERATION

The hoist 2 is advantageously transported to a site in its knocked-down configuration, with the first member 10 separated from the second member 12, and is easily installed by one individual. The second member 12 is secured to the first member 10 by means of the pin 20 being received in aligned openings 16 and 18, as best shown in FIG. 1. Depending on the length of the equipment that would be lifted or lowered into the well 4, the length of the boom 8 would be adjusted appropriately to provide the necessary clearance between the horizontal arm 34 of the second member 12 and the top of the well casing 4.

The well casing 4 is typically square or circular (shown in dashed line) in cross-section, as best shown in FIG. 3. The hoist 2 is secured to the well casing 4 by means of the base member 2 and the belt 6. The clip 46 is used to initially suspend the hoist 2 above the ground while the belt 6 is tightened. The flap surfaces 61 directly engage a vertical wall portion of the well casing 4. As the belt 6 is tightened, the flaps 60 and the corresponding surfaces 61 are forced outwardly from its initial 60° orientation to about 45°, thereby becoming biased toward each other, as best shown in FIG. 3. Thus, the flap surfaces 61 provide maximum surface area in contact with the well casing 4. Slots 66 between each pair of flaps 60 advantageously accommodate the belt 6 where the base member 2 is secured to a well casing having a diameter or diagonal slightly greater than the width of the base wall 56.

A person of ordinary skill in the art will therefore understand from the above description that the hoist R can be used in any type of well casing and without regard to the terrain in which the well is located.

A person of ordinary skill in the art will also understand that while a tripod-supported hoist would require several iterations of adjustments before its apex can be centered over the well opening, the hoist R is immediately self-aligned or self-centered as soon as it is secured to the well casing 4, since the base member 2 acts as an alignment means. When the base member 2 is secured to the well casing 4, the axis of the base member 2 would automatically align with the axis of the well casing 4, thereby also aligning the axis of the boom 8 with the well casing 4. This feature advantageously makes the hoist R relatively easy to use and install compared to tripod-supported hoists, specially where the ground surface around the well casing is substantially uneven. The pulley 26 may have to moved to a different hole 30 to better align the rope 28 over the well opening.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A hoist for lifting and lowering an equipment in a well, said hoist comprising:
   a) a base member;
   b) said base member including a plurality of opposed resilient walls having surfaces adapted to engage a vertical wall portion of a well casing, said resilient walls being adapted to spread apart from each other and thereby becoming biased toward respective opposed walls when said surfaces engage the vertical wall portion of the well casing;
   c) a belt secured to said base member for removably securing said base member to the vertical wall portion of the well casing;
   d) a boom having one end secured to said base member and a free end disposed above the well casing; and
   e) cable disposed on said boom for lowering and lifting an equipment in the well.

2. A hoist as in claim 1, wherein:
   a) said base member is substantially "U"-shaped having first and second leg portions; and
   b) said resilient walls are disposed at the distal end of said leg portions.

3. A hoist as in claim 1, wherein:
   a) said belt is secured to said base member such that said belt makes a complete loop around said base member and the well casing when said base member is secured to the well casing.

4. A hoist as in claim 1, wherein
   a) said boom includes a first longitudinal member having fist and second ends, said first member first end being secured to said base and said first member second end extending above the well casing; and
   b) a second longitudinal member having third and fourth ends, said third end being telescopically received in said first member second end and said fourth end extending above the well casing and comprising said free end of said boom.

5. A hoist as in claim 1, and further comprising:
   a) a winch secured to said base member;
   b) a first pulley disposed at said boom free end; and c) wherein said cable extends from said winch through said first pulley and over and into the opening of the well for attachment to the equipment being lowered and raised within the well.

6. A hoist as in claim 5, and further comprising:

a) means for centering said first pulley over the opening of the well casing.

7. A hoist as in claim 5, wherein:

a) said boom free end includes a substantially horizontal portion disposed over the well opening;

b) said horizontal portion includes a plurality of openings disposed along its length; and c) said boom free end includes means for selectively securing said first pulley to any one of said plurality of openings.

8. A hoist as in claim 5, and further comprising:

a) a second pulley disposed on said boom intermediate said first pulley and said base member.

9. A hoist as in claim 1, and further comprising:

a) a means for varying the length of said boom.

10. A hoist as in claim 1, wherein:

a) said boom includes a first longitudinal member having first and second ends, said first member first end being secured to said base and said first member second end extending above the well casing, and a second longitudinal member having third and fourth ends, said third end being telescopically received in said fist member second end and said fourth end extending above the well casing;

b) a portion of the length of said second longitudinal member includes a plurality of radial holes spaced apart from each other;

c) said second end of said first longitudinal member having a radial opening therethrough; and d) a pin is removably secured to said first member radial opening and one of said plurality of radial holes in said second member.

11. A hoist as in claim 1, wherein:

a) said base member is substantially "U"-shaped and has a base portion; and b) said boom is secured to said base portion.

12. A hoist as in claim 1, and further comprising:

a) a winch secured to said base portion.

13. A hoist for lifting and lowering an equipment in a well, said hoist comprising:

a) a base member;

b) a winch secured to said base member;

c) a belt secured between said winch and said base member for removably securing said base member to a well casing such that said belt makes a complete loop around said base member and the well casing when said base member is secured to the well casing;

d) a boom having first and second ends, said first end being secured to said base member, said second end extending above the well casing; and e) a cable secured to said winch and disposed on said boom for lowering and lifting an equipment in the well.

14. A hoist as in claim 13, wherein:

a) said base member includes opposed walls extending outwardly therefrom, said walls having diverging surfaces defining a channel therebetween such that a portion of the well casing is received within said channel and said surfaces are forced against a vertical portion of the well casing when said base member is secured to the well casing.

15. A hoist as in claim 14, wherein;

a) said walls are resilient.

16. A hoist as in claim 13, and further comprising:

a) a hook secured to said base member for temporarily securing said base member to the well casing.

17. A hoist as in claim 13, wherein:

a) said base member is substantially "U"-shaped and has a base portion; and b) said boom first end is secured to said base portion.

* * * * *